US010458037B2

(12) United States Patent
Choi et al.

(10) Patent No.: US 10,458,037 B2
(45) Date of Patent: Oct. 29, 2019

(54) SYSTEMS AND METHODS FOR PRODUCING ANTI-WETTING STRUCTURES ON METALLIC SURFACES

(71) Applicant: Georgia Tech Research Corporation, Atlanta, GA (US)

(72) Inventors: Won Tae Choi, Atlanta, GA (US); Laurens Victor Breedveld, Atlanta, GA (US); Dennis W. Hess, Atlanta, GA (US); Kkochnim Oh, Atlanta, GA (US); Preet M. Singh, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 265 days.

(21) Appl. No.: 15/336,019

(22) Filed: Oct. 27, 2016

(65) Prior Publication Data

US 2017/0114472 A1 Apr. 27, 2017

Related U.S. Application Data

(60) Provisional application No. 62/246,667, filed on Oct. 27, 2015.

(51) Int. Cl.
*C25F 3/06* (2006.01)

(52) U.S. Cl.
CPC ..... *C25F 3/06* (2013.01)

(58) Field of Classification Search
CPC ..... C25F 3/02–14
See application file for complete search history.

(56) References Cited

FOREIGN PATENT DOCUMENTS

| | | | | | |
|---|---|---|---|---|---|
| CN | 103290418 | A | * | 9/2013 | |
| EP | 2818578 | A1 | * | 12/2014 | ..... C25F 3/06 |
| WO | 2006096127 | A1 | | 9/2006 | |
| WO | 2009072738 | A1 | | 6/2009 | |
| WO | 2010056933 | A2 | | 5/2010 | |
| WO | 2013094959 | A1 | | 6/2013 | |
| WO | WO-2015092133 | A1 | * | 6/2015 | ..... C25C 7/02 |

* cited by examiner

*Primary Examiner* — Nicholas A Smith
(74) *Attorney, Agent, or Firm* — Troutman Sanders LLP; Ryan A. Schneider; Micah B. Hensley

(57) ABSTRACT

An exemplary embodiment of the present invention provides a method for anti-wetting metallic surfaces. A metallic object is introduced to an electrochemical solution. A cathode is introduced to the electrochemical solution, and an anode is attached to the metallic object. An electric potential between the cathode and anode is applied, such that selective electrochemical etching of the surface of the metallic object occurs. The selective etching etches grain boundaries at the surface of the metallic object, and the grain boundaries define grain faces.

16 Claims, 3 Drawing Sheets

SYSTEMS AND METHODS FOR PRODUCING ANTI-WETTING STRUCTURES ON METALLIC SURFACES

CROSS-REFERENCE TO RELATED APPLICATIONS

This application claims the benefit of U.S. Provisional Application Ser. No. 62/246,667, filed on 27 Oct. 2015, which is incorporated herein by reference in its entirety as if fully set forth below.

TECHNICAL FIELD OF THE INVENTION

The various embodiments of the present disclosure relate generally to anti-wetting surfaces. More particularly, the various embodiments of the present invention are directed to anti-wetting structures on metallic surfaces.

BACKGROUND OF THE INVENTION

Several processes, industries, and applications require a metallic surface to come into contact with a liquid. Water and other liquids, for instance, are often pumped through metallic pipes. Boats and other water vessels may have metallic hulls that contact water. Other industries, including but not limited to, petrochemical, power generation, food, and construction industries, also include liquid exposure to a metallic surface. Many, if not all, of these processes would benefit from liquid repellency at a metallic surface. For example, liquid repellency in pipes could enable more efficient fluid transport due to hydrodynamic drag reduction, which could lead to more effective drainage or cleaning of storage tanks, for instance. In other applications, such as power generation and desalination industries, enhanced heat transfer efficiency during drop-wise condensation of water vapor could save energy, and thus money. Liquid repellency could also improve the corrosive resistance of a metallic surface, thereby prolonging the lifetime of construction materials, as one example.

Previous efforts to fabricate water-repellant metallic surfaces include methods using laser ablation, surface coating, electrodeposition, electro-less deposition, and chemical etching. Surface roughness may be created with high fidelity and good mechanical stability by laser ablation techniques, but the process is difficult and scale up is costly. Surface roughness can also be created by application of a coating that has inherent roughness, such as one with embedded particles, but this method can generate intrinsic stress that can degrade both the mechanical stability of the surface and the interface between the metallic object and the coating. In such a method, adhesion of the particles and/or coating is also a concern. Electrodeposition or electro-less deposition methods to induce roughness on metallic surfaces also raise concerns about adhesion and mechanical stability at the interface between the deposited material(s) and the metallic object due to intrinsic and/or thermal stresses. Chemical etching methods often result in sharp features of the metallic surface, which may lack the necessary mechanical stability for wide applicability.

Therefore, there is a desire for a method to create a liquid-repellant metallic surface that is mechanically stable. Further, there is a desire for a method for anti-wetting a metallic surface that is scalable. Various embodiments of the present invention address these desires.

BRIEF SUMMARY OF THE INVENTION

The present invention relates to anti-wetting structures on metallic surfaces. An exemplary embodiment of the present invention provides a method for creating anti-wetting structures on metallic surfaces. The method can comprise introducing a metallic object to an electrochemical solution, attaching a cathode to the electrochemical solution, and attaching an anode to the the metallic object. A first electric potential can be applied between the cathode and anode, such that selective electrochemical etching of a surface of the metallic object occurs. The selective etching may etch grain boundaries at the surface of the metallic object, and the grain boundaries may define grain faces.

In some embodiments of the present invention, the first electrical potential can generate a first current density at the grain boundaries and a second current density at the grain faces, such that a first current density difference may be defined as the first current density less the second current density.

In some embodiments of the present invention, a second electrical potential can be applied between the cathode and anode, wherein the first electrical potential may be different than the second electrical potential.

In some embodiments of the present invention, the first electrical potential can be lower than the second electrical potential.

In some embodiments of the present invention, the first electrical potential can generate a first current density at the grain boundaries and a second current density at the grain faces, such that a first current density difference may be defined as the first current density less the second current density. The second electrical potential can generate a third current density at the grain boundaries and a fourth current density at the grain faces, such that a second current density difference may be defined as the third current density less the fourth current density. The first current density difference may be greater than the second current density difference.

In some embodiments of the present invention, application of the first electrical potential may selectively etch the grain boundaries to create microscale roughness and application of the second electrical potential may selectively etch nanoscale roughness on the grain faces.

In some embodiments of the present invention, the second electrical potential may be lower than a threshold that leads to electrochemical polishing.

In some embodiments of the present invention, deposition of a film onto the surface metallic object may occur.

In some embodiments of the present invention, the film may be deposited with a thickness that that may maintain the nanoscale roughness on the grain faces.

In some embodiments of the present invention, the film may alter a surface chemistry of the metallic object.

In some embodiments of the present invention, the film may comprise fluorocarbon.

In some embodiments of the present invention, the electrochemical solution may comprise nitric acid.

In some embodiments of the present invention, the metallic object may comprise a metal alloy.

Another exemplary embodiment of the present invention provides a method for creating anti-wetting structures on metallic surfaces. The method can comprise providing a metallic object and electrochemically etching the metallic object at a first electrical potential to etch grain boundaries at a surface of the metallic object. The grain boundaries may define grain faces.

In some embodiments of the present invention, the method may comprise electrochemically etching the metallic object at a second electrical potential that may be different than the first electrical potential.

In some embodiments of the present invention, the second electrical potential may be greater than the first electrical potential.

In some embodiments of the present invention, electrochemically etching the metallic object at the first electrical potential may create microscale roughness on the surface of the metallic object, and electrochemically etching the metallic object at the second electrical potential may create nanoscale roughness on the surface of the metallic object.

In some embodiments of the present invention, when the surface is placed into contact with water, the surface and the water have a static contact angle of at least 140 degrees.

In some embodiments of the present invention, when the surface is placed into contact with water, the surface and the water have a static contact angle of at least 150 degrees.

In some embodiments of the present invention, when the surface is placed into contact with water, the surface and the water have a static contact angle of at least 160 degrees.

These and other aspects of the present invention are described in the Detailed Description of the Invention below and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

BRIEF DESCRIPTION OF THE DRAWINGS

The following Detailed Description of the Invention is better understood when read in conjunction with the appended drawings. For the purposes of illustration, there is shown in the drawings exemplary embodiments, but the subject matter is not limited to the specific elements and instrumentalities disclosed.

DETAILED DESCRIPTION OF THE INVENTION

Figure 1:
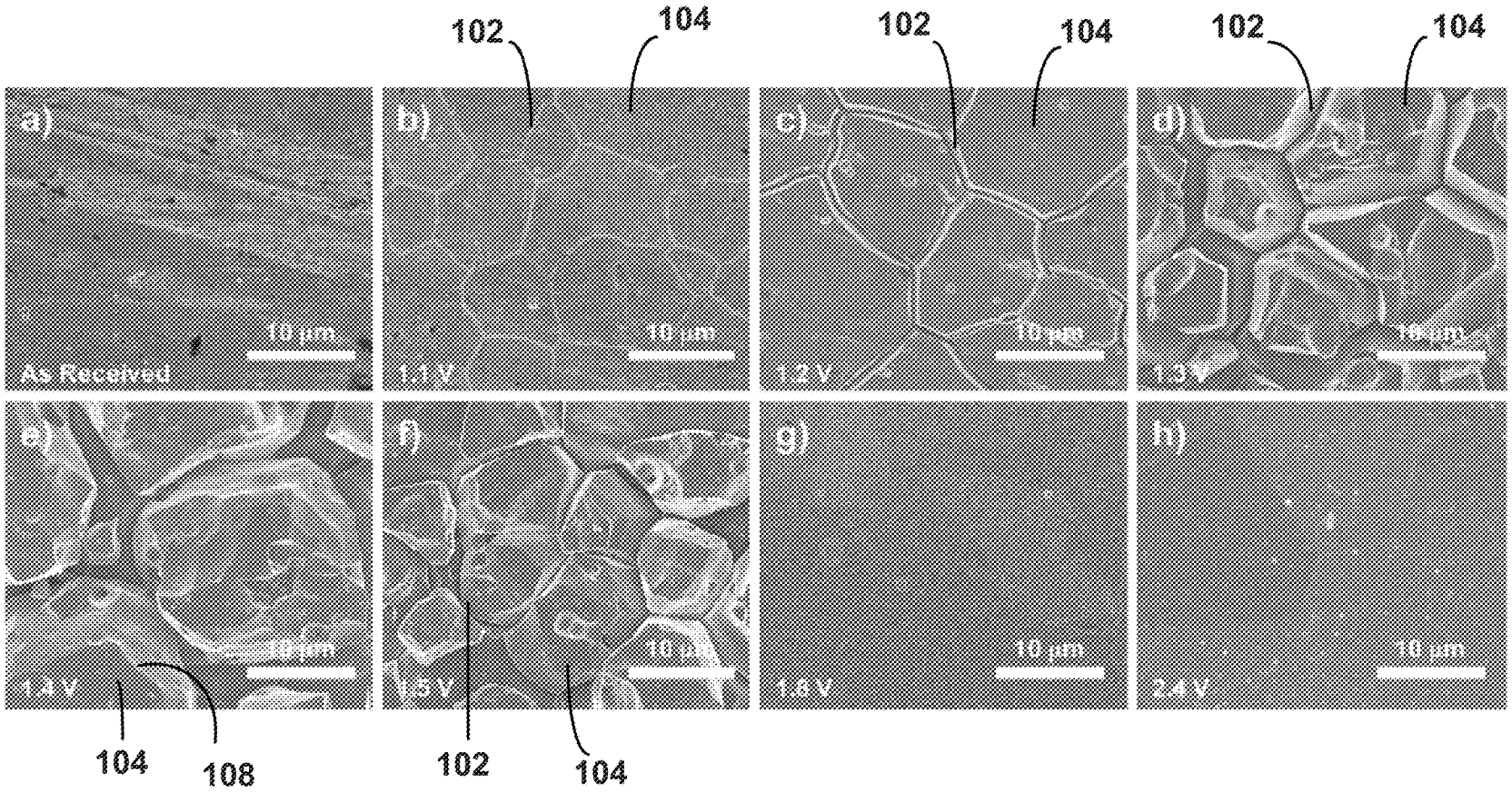
FIG. 1 provides a panel of low-magnification images depicting a progression of electric potentials applied to a metallic sample, in accordance with an exemplary embodiment of the present invention.

To facilitate an understanding of the principles and features of the present invention, various illustrative embodiments are explained below. To simplify and clarify explanation, the invention is described below as applied to anti-wetting metallic surfaces. One skilled in the art will recognize, however, that various embodiments of the present invention find application in areas, including, but not limited to, metallic piping, marine applications, medical tools, petrochemical industries, power generation industries, food industries, construction industries, and the like.

The components, steps, and materials described hereinafter as making up various elements of the invention are intended to be illustrative and not restrictive. Many suitable components, steps, and materials that would perform the same or similar functions as the components, steps, and materials described herein are intended to be embraced within the scope of the invention. Such other components, steps, and materials not described herein can include, but are not limited to, similar components or steps that are developed after development of the invention.

An exemplary embodiment of the present invention provides a method for creating structures within the substrate or bulk material of a metallic object itself. This may be accomplished, for instance, by intentionally enhancing the intrinsic grain structure of the metallic object at its surface via selective grain boundary etching. Grain boundary etching, or inter-granular corrosion, may describe a situation where boundaries of crystallites in a material are etched selectively relative to their grain surfaces. Under certain conditions, etching or oxidation of metals at grain boundaries may occur more rapidly than etching or oxidation reactions of metal grain surfaces (also referred to as grain matrices). The difference in etch rate between the grain boundary and grain surface may originate, for example, from the presence of structural defects or variations in an alloy's composition at the grain boundaries, which may have higher interfacial energy and relatively weak bonding. This may result in accelerated etch rates at the grain boundaries, as compared to that at the grain surfaces.

Selective electrochemical etching may utilize this difference in etch rates and may accentuate intrinsic grain structures, which may create roughness. If this roughness is of the proper length scale, water-repellant surfaces may result. Because the structures that create the roughness may be integral to the metallic object, relatively high mechanical stability of the structures may be realized, as compared to structures generated from deposition or addition of particles.

Thus, a method utilizing selective electrochemical etching may create grain boundary etching, which may lead to changes in surface topography of a metallic object. Water wetting behavior of such surfaces may be correlated with the topography of these surfaces. Further, there may be a relationship between applied electric potential and surface structure of a metallic object.

An exemplary embodiment of the present invention electrochemically etches the surface of a metallic object comprising stainless steel 316 ("SS316"). In some embodiments, an electrochemical solution comprising nitric acid may be used. In certain embodiments, a metallic object may be introduced to the electrochemical solution. In some embodiments, a cathode may be introduced to the electrochemical solution, and an anode may be electrically connected to the metallic object. In certain embodiments, a first electric potential between the cathode and anode may be applied to the metallic object. In some embodiments, a third electrode is used as a reference electrode to provide a well-defined potential during the electrochemical etching process. In certain embodiments, the third, reference electrode may be a saturated calomel electrode.

Different electric potentials may affect the grain boundaries and grain surfaces of the metallic object to varying degrees. For example, FIG. 1 contains multiple panels that show low-magnification (3,000×) scanning electron microscope images of an SS316 specimen subjected to different electric potentials. FIG. 1*a* may depict an SS316 sample that has not been subjected to an electric potential. FIG. 1*b* may depict an SS316 sample that has been electrochemically etched at 1.1 V of electric potential, which may generate narrow grain boundaries 102. These grain boundaries 102 may define grain matrices or grain surfaces 104.

FIG. 1*c* may depict an SS316 sample that has been electrochemically etched at 1.2 V of electric potential, which may result in widened etched grain boundaries 102. At this voltage, the width of the etched grain boundaries 102 may be increased relative to those shown in FIG. 1*b*, but the flat top surface of the grain surfaces 104 may be maintained. FIG. 1*d* depict an SS316 sample that has been electrochemically etched at 1.3 V of electric potential. At this voltage, the distance between grain surfaces 104 may increase, and the grain surfaces 104 may begin to show dissolution. Higher electric potential values, such as those shown in FIGS. 1*e* and 1*f* may lead to rounded grains 106, which may be due to significant etching of the grain edges 108 and grain surfaces 104. At even higher electric potential values, such as those shown in FIGS. 1*g* and 1*h*, identifiable grain structures may be unobservable.

Figure 2:
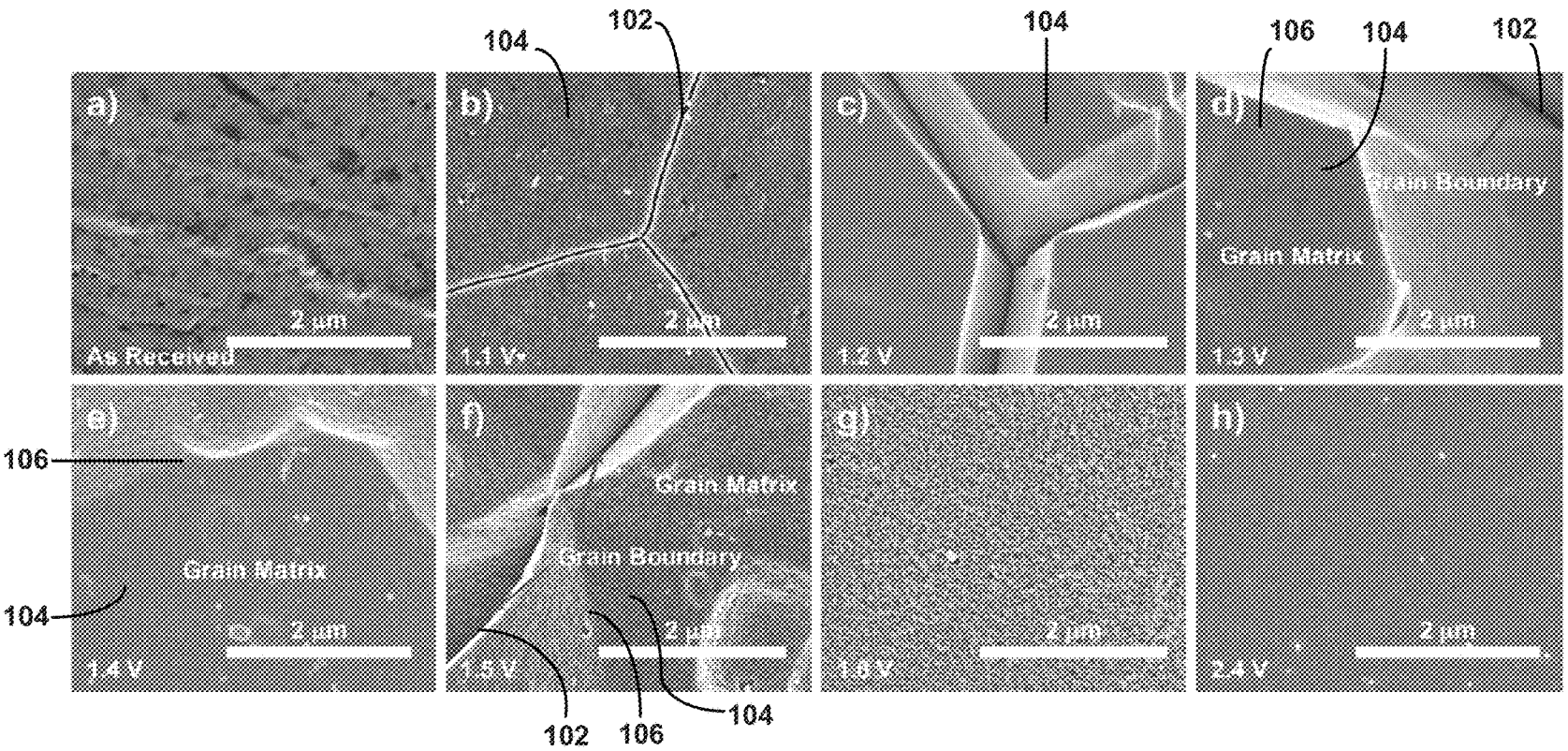
FIG. 2 provides a panel of high-magnification images depicting a progression of electric potentials applied to a metallic sample, in accordance with an exemplary embodiment of the present invention.

FIG. 2 contains multiple panels that show high-magnification (20,000×) scanning electron microscope images of an SS316 specimen subjected to different electric potentials. FIG. 2*a* may depict an SS316 sample that has not been subjected to an electric potential. Initial roughness of SS316 sample due to manufacturing processes performed to the SS316 sample may be observed. FIG. 2*b* may depict an SS316 sample that has been electrochemically etched at 1.1 V of electric potential, which may generate narrow grain boundaries 102. The application of 1.1 V of electric potential to an SS316 sample may not, however, completely remove initial features of the SS316 sample that existed due to mechanical process of the SS316 sample. These grain boundaries 102 may define grain matrices or grain surfaces 104.

FIG. 2*c* depicts an SS316 sample that has been electrochemically etched at 1.2 V of electric potential, which may eliminate the initial roughness of the SS316 sample. Applying 1.2 V of electric potential to an SS316 sample may also result in flat grain surfaces 104. High electric potentials (such as 1.3 V, 1.4 V, and 1.5 V, shown in FIGS. 2*d*, 2*e*, and 2*f*, respectively) may result in rounded grains 106 and the evolution of nanoscale roughness on the grain surfaces 104. Application of an electric potential of 1.8 V to an SS316 sample may yield a surface with only a nanoscale structure that may lack grain boundary etching, as depicted in FIG. 2*g*. At an electric potential of 2.4 V, an SS316 sample may exhibit a smooth surface, as depicted in FIG. 2*h*.

As can be seen from the images shown in FIGS. 1 and 2, different surface structures on a metallic object may be achieved by controlling the anodic potential in an electrochemical system.

Electrochemical etching at different applied potentials for the same period of time may result in different levels of total charge transported to the metallic sample, because current densities may vary.

In certain embodiments, a metallic object may be electrochemically etched at a single electric potential. In some embodiments, a metallic object may be electrochemically etched at a first potential and then etched at a second potential. In some embodiments, the first potential is less than the second potential. In some embodiments, the first potential is greater than the second potential. In certain embodiments, a metallic object may be electrochemically etched at more than two electric potentials, which may include any electrochemical etchings at any number of electric potentials.

In certain embodiments, a coating may be applied to a metallic sample after it has been electrochemically etched. In some embodiments, that coating comprises fluorocarbon. In some embodiments, the coating has a thickness that is less than the nanostructures created by the electrochemical etching.

Figure 3:
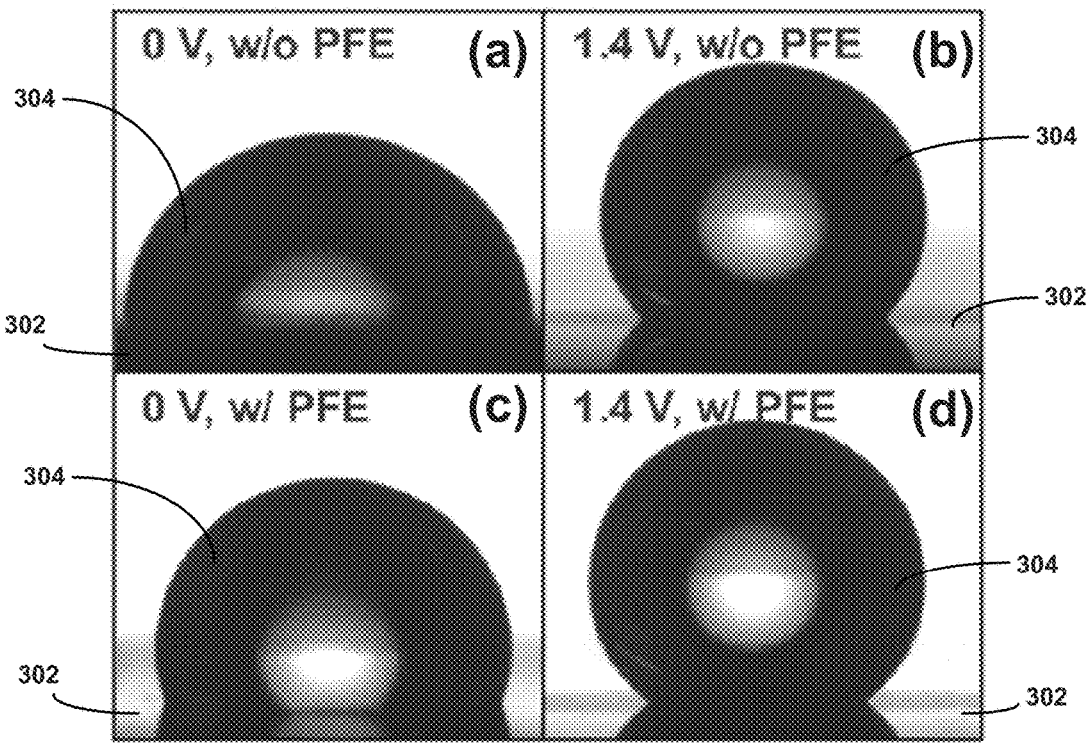
FIG. 3 provides a panel of images depicting the static contact angle of water on non-electrochemically etched and electrochemically etched metallic samples with and without fluorocarbon deposition, in accordance with an exemplary embodiment of the present invention.

The static contact angle of an object may indicate the level of liquid repellency of that object. An increase in static contact angle may indicate a higher degree of liquid repellency. FIG. 3 contains a panel of images. FIG. 3*a* shows an SS316 sample 302 that is not electrochemically etched and is not coated with fluorocarbon. A water droplet 304 is in contact with the SS316 sample 302. FIG. 3*b* shows an SS316 sample 302 that was electrochemically etched at 1.4 V and is not coated with fluorocarbon. A water droplet 304 is in contact with the SS316 sample 302. The SS316 sample 302 in FIG. 3*b* may repel the water droplet 304 to a greater degree than the SS316 sample 302 in FIG. 3*a*.

FIG. 3*c* shows an SS316 sample 302 that is not electrochemically etched and is coated with fluorocarbon. A water droplet 304 is in contact with the SS316 sample 302. FIG. 3*d* shows an SS316 sample 302 that was electrochemically etched at 1.4 V and is coated with fluorocarbon. A water droplet 304 is in contact with the SS316 sample 302. The SS316 sample 302 in FIG. 3*d* may repel the water droplet 304 to a greater degree than the SS316 sample 302 in FIG. 3*c*. Further, the SS316 sample 302 in FIG. 3*d* may repel the water droplet 304 to a greater degree than the SS316 sample 302 in FIG. 3*b*.

As can be seen from FIGS. 3*a*-3*d*, the degree of liquid repellency may be improved by electrochemically etching a metallic object. Further, liquid repellency may be improved by further coating or altering the chemistry of an electrochemically etched metallic object.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

What is claimed is:

1. A method comprising:

introducing a metallic object to an electrochemical solution, wherein the metallic object has a surface;

introducing a cathode to the electrochemical solution;

attaching an anode to the metallic object;

generating microscale roughness on the metallic object by applying a first electric potential between the cathode and anode, such that selective electrochemical etching of the surface of the metallic object occurs, wherein the selective etching etches grain boundaries at the surface of the metallic object, the grain boundaries defining grain faces; and subsequent to generating the microscale roughness on the metallic object, generating nanoscale roughness on the grain faces by applying a second electrical potential between the cathode and anode, the second electrical potential being less than or equal to approximately 2.4 volts and the first electrical potential being less than the second electrical potential.

2. The method of claim 1, wherein the first electrical potential generates a first current density at the grain boundaries and a second current density at the grain faces, such that a first current density difference is defined as the first current density less the second current density.

3. The method of claim 1, wherein the first electrical potential generates a first current density at the grain boundaries and a second current density at the grain faces, such that a first current density difference is defined as the first current density less the second current density;

wherein the second electrical potential generates a third current density at the grain boundaries and a fourth current density at the grain faces, such that a second current density difference is defined as the third current density less the fourth current density; and wherein the first current density difference is greater than the second current density difference.

4. The method of claim 1, wherein the second electrical potential is less than a threshold that leads to electrochemical polishing.

5. The method of claim 1, further comprising depositing a film onto the surface metallic object.

6. The method of claim 5, wherein the film is deposited with a thickness that maintains the nanoscale roughness on the grain faces.

7. The method of claim 6, wherein the film alters a surface chemistry of the metallic object.

8. The method of claim 6, wherein the film comprises fluorocarbon.

9. The method of claim 1, wherein the electrochemical solution comprises nitric acid.

10. The method of claim 1, wherein the metallic object comprises a metal alloy.

11. A method comprising:

providing a metallic object;

generating microscale roughness by electrochemically etching the metallic object at a first electrical potential to etch grain boundaries at a surface of the metallic object, the grain boundaries defining grain faces; and subsequent to generating the microscale roughness, generating nanoscale roughness on the surface of the metallic object by electrochemically etching the metallic object at a second electrical potential greater than the first electrical potential, the second electrical potential being less than or equal to approximately 2.4 volts.

12. The method of claim 11, wherein, when the surface is placed into contact with water, the surface and the water have a static contact angle of at least 140 degrees.

13. The method of claim 11, wherein, when the surface is placed into contact with water, the surface and the water have a static contact angle of at least 150 degrees.

14. The method of claim 11, wherein, when the surface is placed into contact with water, the surface and the water have a static contact angle of at least 160 degrees.

15. The method of claim 1, wherein the first electrical potential is greater than or equal to approximately 1.1 volts.

16. The method of claim 11, wherein the first electrical potential is greater than or equal to approximately 1.1 volts.

* * * * *